US007392568B2

(12) United States Patent
Koschel et al.

(10) Patent No.: US 7,392,568 B2
(45) Date of Patent: Jul. 1, 2008

(54) HAND-HELD POWER TOOL WITH AN AUXILIARY HANDLE

(75) Inventors: Christian Koschel, Augsburg (DE); Rolf Spangenberg, Gauting (DE)

(73) Assignee: Hilt Aktiengesellschaft, Schaan (LI)

( * ) Notice: Subject to any disclaimer, the term of this patent is extended or adjusted under 35 U.S.C. 154(b) by 348 days.

(21) Appl. No.: 11/095,272

(22) Filed: Mar. 31, 2005

(65) Prior Publication Data

US 2005/0217440 A1 Oct. 6, 2005

(30) Foreign Application Priority Data

Apr. 1, 2004 (DE) ..... 10 2004 016 088

(51) Int. Cl.
*B25G 1/10* (2006.01)

(52) U.S. Cl. ..... 16/426; 16/438; 16/900; 16/436

(58) Field of Classification Search ..... 16/426, 16/408, 429, 436; 21/177.2, 177.5–9; 294/58; 408/124, 241 R; 73/523, 551.9, 525, 543; 451/451–454, 354, 359, 524–525, 357, 344; 30/383, 276

See application file for complete search history.

(56) References Cited

U.S. PATENT DOCUMENTS 1,531,131 A * 3/1925 Price ..... 30/519
2,513,271 A * 7/1950 Bluemink et al. ..... 173/170
2,545,659 A * 3/1951 Ginter ..... 16/426
2,742,936 A * 4/1956 Cooley ..... 30/519
4,136,579 A * 1/1979 Robinson et al. ..... 74/523
5,265,307 A * 11/1993 Hull et al. ..... 16/406
5,269,045 A * 12/1993 DeSerio et al. ..... 16/422
5,291,928 A * 3/1994 Keith et al. ..... 144/371
5,381,595 A * 1/1995 Keith et al. ..... 29/467
5,687,483 A * 11/1997 Neubert et al. ..... 30/312
5,725,422 A * 3/1998 Leweck ..... 451/359
6,241,594 B1 * 6/2001 Lepold ..... 451/359
6,499,172 B1 * 12/2002 McCracken ..... 15/97.1
6,863,479 B2 * 3/2005 Frauhammer et al. ... 408/241 R

FOREIGN PATENT DOCUMENTS

DE 32 29 183 C2 2/1984
DE 36 34 424 A1 4/1988
DE 3921752 A1 * 1/1991
DE 196 06 535 A1 8/1997
DE 197 45 306 A1 4/1999
DE 10063445 A1 * 7/2002
EP 347869 A * 12/1989
GB 2124536 A * 2/1984
GB 2203363 A * 10/1988
JP 08309678 A * 11/1996
JP 09001478 A * 1/1997
JP 09109065 A * 4/1997

OTHER PUBLICATIONS

Page 2 of the German Office Action in DE 10 2004 016 088, which is the priority document of the present application.

* cited by examiner

*Primary Examiner*—Chuck Y. Mah
(74) *Attorney, Agent, or Firm*—Abelman, Frayne & Schwab

(57) ABSTRACT

A hand-held power tool, such as an angular grinder, includes a housing having a main handle, and a support member for supporting a side handle in different positions relative thereto and pivotable relative to the housing about two support points, which may be on opposite side surfaces of the housing.

11 Claims, 4 Drawing Sheets

Fig. 2
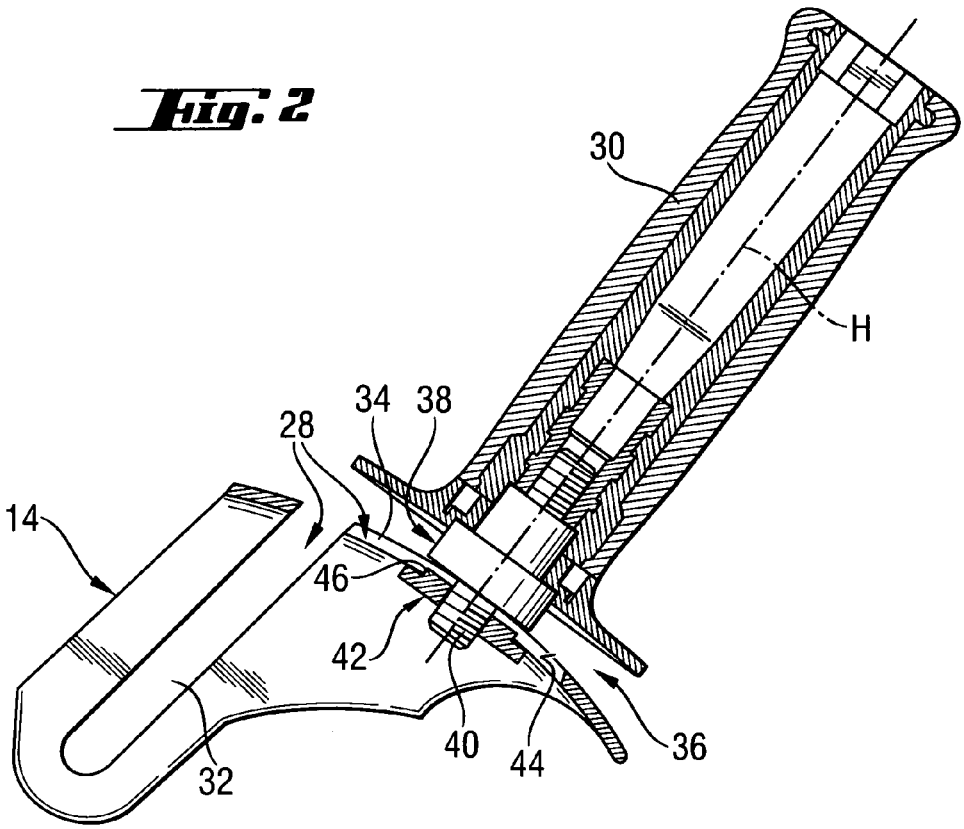
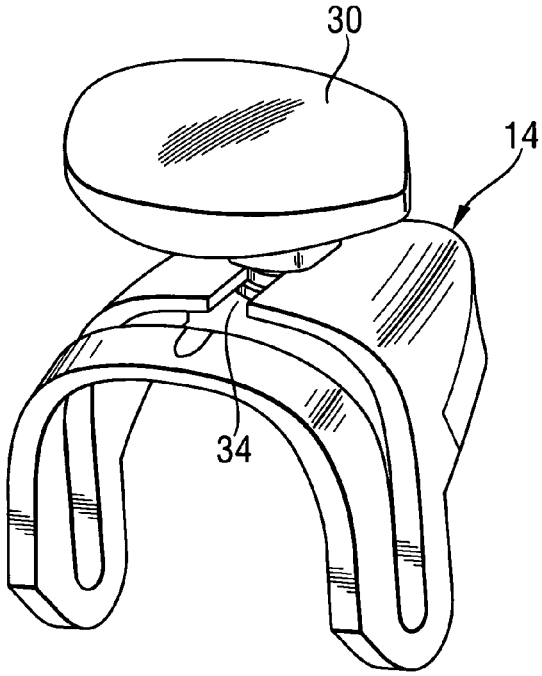
Fig. 3

HAND-HELD POWER TOOL WITH AN AUXILIARY HANDLE

BACKGROUND OF THE INVENTION

1. Field of the Invention

The present invention relates to a hand-held power tool and, in particular, an angular grinder including a housing having a main handle, a side handle, and a support member pivotable relative to the housing and supporting the side handle in different positions of the side handle relative to the support member.

2. Description of the Prior Art

In the power tools of the type described above, the position of the side handle relative to the main handle can be changed to adapt the arrangement of the handles to different applications and to provide for a good holding for each application. In addition, such hand-held power tools can be adapted without any problems to the use by both left-hander and right-hander.

German Publication DE-197 45 306 discloses an angular grinder with a support provided on the grinder housing. The support has two receptacles for alternatively securing a side handle. Moreover, the support can be secured relative to the housing in different pivotal positions, whereby simultaneously the positions of the receptacles relative to the housing also change.

The drawback of the known solution consists in that the connection of the support and the housing should withstand large forces and, at the same time, should insure variable positions of the support. This involves relatively large manufacturing costs. In addition, with so supported side handles, during the operation, relatively strong vibrations are transmitted to the hand of the operator, which leads to a poor handling of the tool and to a rapid fatigue of the operator. Further in some applications, e.g., grinding, because of a sidewise projecting support, no optimal gripping or holding of the tool is achieved that would have permitted to comfortably apply high press-on forces.

Accordingly, the object of the present invention is to provide a hand-held tool with an auxiliary handle in which the above-mentioned drawbacks of such tools are eliminated.

Another object of the present invention is to provide a hand-held tool with an auxiliary handle of the type discussed above that would insure a comfortable holding for each type of applications.

SUMMARY OF THE INVENTION

These and other objects of the present invention, which will become apparent hereinafter, are achieved by providing two support points about which the support member can be pivoted relative to the tool housing.

The provision of two support points permits a very stable attachment of the side handle to the housing. The two support points provide for a relatively large pivot region of the support member, which can expand positioning possibilities of the side handle. Due to a locking connection of the support member with the housing, only small vibrations are applied to a side handle. Altogether, with the support member being supported at two pivot points, a comfortable holding of a power tool in all applications is achieved.

Advantageously, the two pivot point are provided on opposite side surfaces of the housing. Thereby, a particular stable connection between the side handle and the housing is realized.

In a particularly advantageous embodiment, the support member surrounds an upper surface of the housing remote from the working tool. Simultaneously, the support member forms a hand support surface. Thereby, an additional holding possibility is provided which is also suitable for a one-hand guidance of the power tool. In addition, the holding hand is spaced, on one hand, from the gear housing that can be heated during operation. On the other hand, the holding hand can be so positioned that the rotational axis of the working tool intersects the hand, which insures a particular good transmission of a force from the hand to the working tool. Thereby, e.g., upon grinding, a particular good output can be achieved.

Advantageously, the support member is formed as a stirrup-shaped handle. This provides a further holding possibility which insures a very stable holding of the power tool.

Advantageously, the support member is removably connected with the housing to obtain a particular slim shape of the power tool when the side handle is not needed.

The side handle is removably connected with the support member, which insures unobstructed positioning of a hand on the hand supporting surface, and the stirrup-shaped handle is provided.

Advantageously, the side handle includes a locking device for securing the support member to the housing. With the locking device, in a simple way, a stable connection of the side handle with the support member is insured.

It is advantageous when the locking device is manipulated by rotation of the side handle about its axis. In this way, the position of the side handle can be secured or changed particularly easy without using any tool.

Advantageously, a guide is provided in the support member along which the side handle is secured. Thereby, the side handle can be repositioned particularly easy.

Advantageously, the guide is formed by limiting surfaces of an opening formed in the support member. In this way, the support member or guide can be produced particularly easily and cost-effectively.

It is advantageous, when the locking device includes a slide block for guiding the locking device along the opening in the support member. The outer dimensions of the slide block are somewhat smaller than the distance between the limiting surfaces. Thereby, the locking device can be displaced, together with the remaining parts of the side handle, along the guide in a new position already when the locking device is only slightly loosened. As a result, the side handle need not to be separated from the support member in order to be repositioned. This simplifies handling of the side handle.

Advantageously, the guide has an arcuate, preferably, U-shaped profile that extends from one of the opposite sides of the housing to another of the opposite sides. By displacing the side handle along the guide, a rapid change from left-hand handling to the right-hand handling and vice versa is insured.

Instead or in addition, the guide has an elongate section that extends substantially perpendicular to the pivot axis of the support member. This ensures additional positioning possibilities of the side handle. E.g., in an angular grinder, the side handle can be so arranged that the pivot axis of the grinder is located between the side handle and the main handle. Thereby, during grinding, a high press-on force can be applied with, simultaneously, comfortable holding of the tool.

Advantageously, the elongate section opens into the arcuate section. Thereby, the side handle can be positioned along the guide from the elongate section to the arcuate section and vise versa, without the side handle being separated from the support member.

It is further advantageous when the side handle has a knob shape. This insures a particularly comfortable two-hand guidance of the power tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show:

FIG. 2 a cross-sectional view through a support member of the power tool shown in FIG. 1 and a secured thereto, side handle;

FIG. 3 a perspective view of the support member shown in FIG. 3 with another embodiment of the side handle;

DETAILED DESCRIPTION OF THE PREFERRED EMBODIMENT

Figure 1:
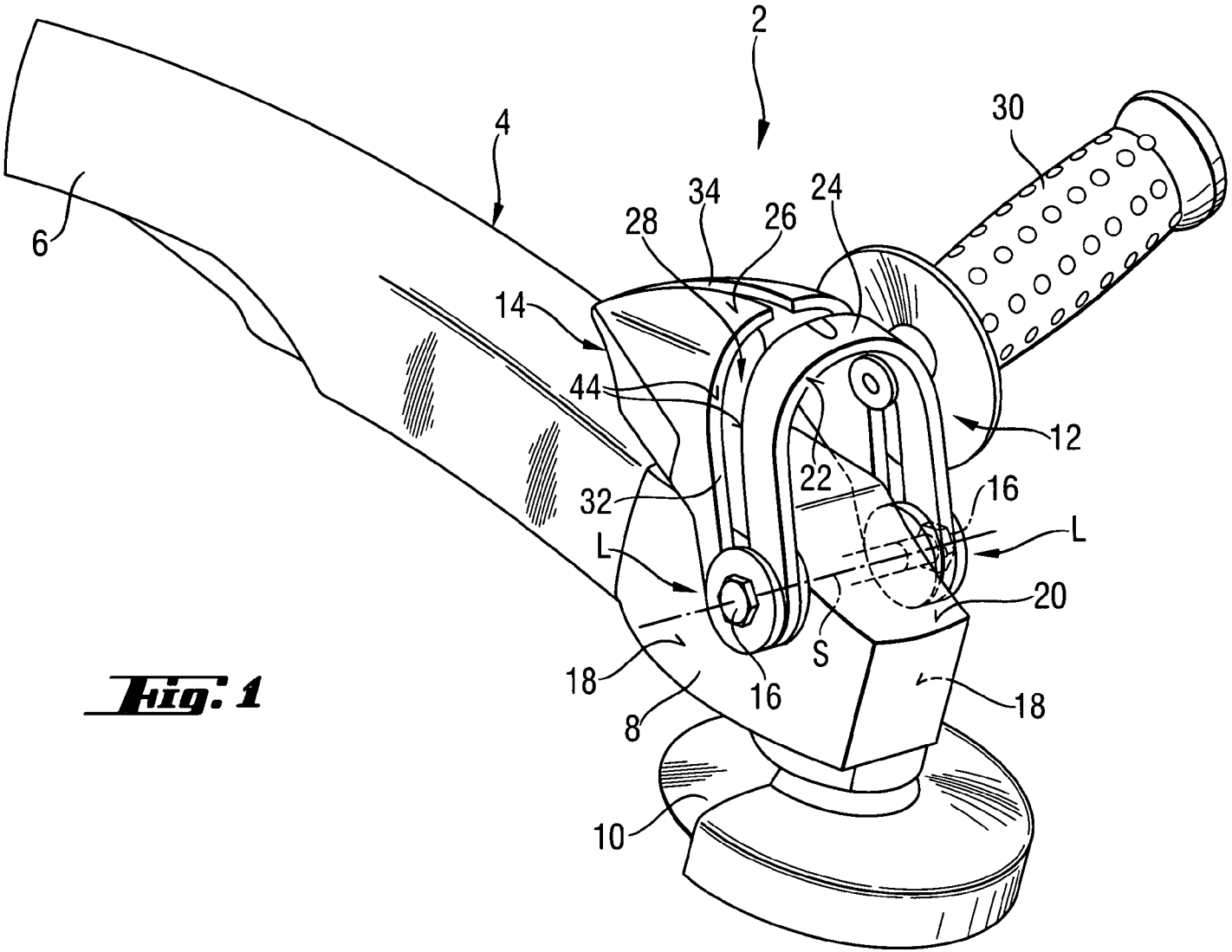
FIG. 1 a perspective view of a hand-held power tool according to the present invention.

A power tool 2 according to the present invention, which is shown in FIG. 1, is formed as an angular grinder and includes a housing 4 forming a main handle 6. At its end remote from the handle 6, the housing 4 has a gear housing 8. In the gear housing 8, there is located a drive (not shown) for driving a tool disc 10 in form of a separating or grinding disc.

On the gear housing 8, an auxiliary handle 12 is arranged. The auxiliary handle 12 has a dome-shaped support member 14 rotatable about a pivot axis S. The pivot axis S is formed by two screws 16 screwed in at opposite side surfaces 18 of the gear housing 8 and holding the support member 14 on the housing 4. The support member 14 has a U-shaped profile surrounding the upper surface 20 of the gear housing 8. The support member 14 forms, at an end side 22 thereof, a stirrup handle 24 that can be used during operation for a stable holding of the power tool 2.

The dome-shaped profile of the support member 14 provides for formation of a hand-supporting surface 26 spaced from the upper surface 20. The support member 14 can be comfortably held on the upper surface 20 and be used as a handle for a one-hand guidance of the power tool 2.

The support member 14 has an opening 28 that serves as a guide and for securing a side handle 30. The opening 28 has an arcuate section 32 having, e.g., a U-shape that extends from one side surface 18 to the opposite side surface 18. The opening 28 further has an elongate section 34 that extends transverse to the pivot axis S and opens at a right angle in the arcuate section 32.

As shown in FIG. 2, the side handle 30 includes a locking device 36 for releasably securing the side handle 30 in the opening 30 of the support member 14. The locking device 36 has a locking member 38 having a threaded portion 40 extending through the opening 28. A locking disc 42 is screwed on the threaded portion 40. The locking disc 42 engages from beneath two limiting surfaces 44 that are formed by the opening 28 and only one of which is shown. The locking member 38 is rotated relative the locking disc 42 as a result of rotation of the side handle 30 about its main axis H. By rotating the locking member 38, a locking position of the locking device 36 is set. In the locking position of the locking device 36, the limiting surfaces 44 are clamped between the locking disc 42 and the locking member 38. In order to position the side handle 30 in the opening 28, the set locking position of the locking device 36 is released, and the side handle 30 is repositioned. In case the side handle 30 is not needed, the locking device 36 is completely released in order to remove the side handle 30 from the support member 14. In all cases, the locking device 36 is manipulated by rotation of the side handle 30, without use of any tool.

A cuboid-shaped sliding block 46 is formed on the locking disc 42. The width of the sliding block 46 is somewhat smaller than the width of the opening 28. Thereby, on one hand, the locking disc 42 is retained, without being rotated, between the limiting surfaces 44 and the locking member 38 during rotation of the locking member 38, whereby the locking device 36 becomes locked or is released. On the other hand, the slide block 46 serves for guiding the locking device 36 or the side handle 30 along the opening 28 in the release position of the locking device 36.

FIG. 3 shows the support member 14 is separated from the housing 4, together a knob-shaped handle 30 secured thereto. In FIG. 3, the handle 30 is secured in the elongate section 34 of the opening 28 and, in this position, insures a particularly comfortable holding of the power tool 2.

Figure 4:
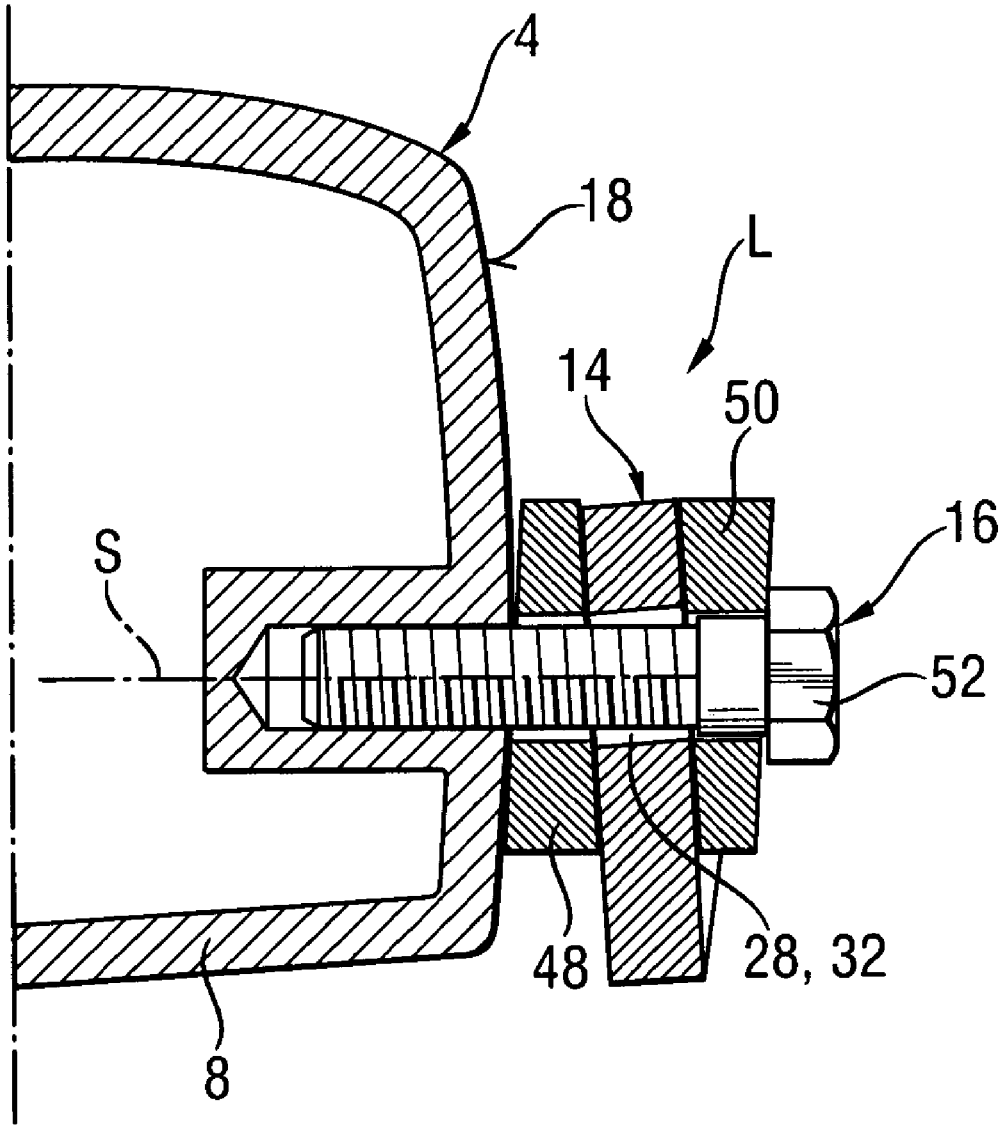
FIG. 4 a cross-sectional view through a support of the support member on the housing of the power tool shown in FIG. 1.

FIG. 4 shows a cross-sectional view through one of the two support points L of the support member 14 on the housing 4 and which is formed essentially by a screw 16 that is screwed in the housing 4. The screw 16 extends through the opening 28 of the support member 14 at an end of the arcuate section 32 of the opening 28 and through a spacing washer 48 which is provided between the housing 4 and the support member 14, on one hand, and through a further spacing washer 50 provided between the support member 14 and a screw head 52, on the other hand.

Both spacing washers 48, 50 are wedge shaped. The first spacing washer 48 is so formed that an angle between the side surface 18 and the support member is equalized in the region of the support point L. The second spacing washer 50 compensates the inclination position between the support member 14 and the screw head 52. This insures a stable retention of the support member 14 on the housing 4 and an easy pivotal movement of the support member 14, without jamming, when the screw 16 is loosen even slightly.

In case neither side handle 30 nor the support member 14 are needed, the screw 16 can be completely screwed out of the gear housing 8 in order to separate the support member 14 from the housing 4.

Figure 5:
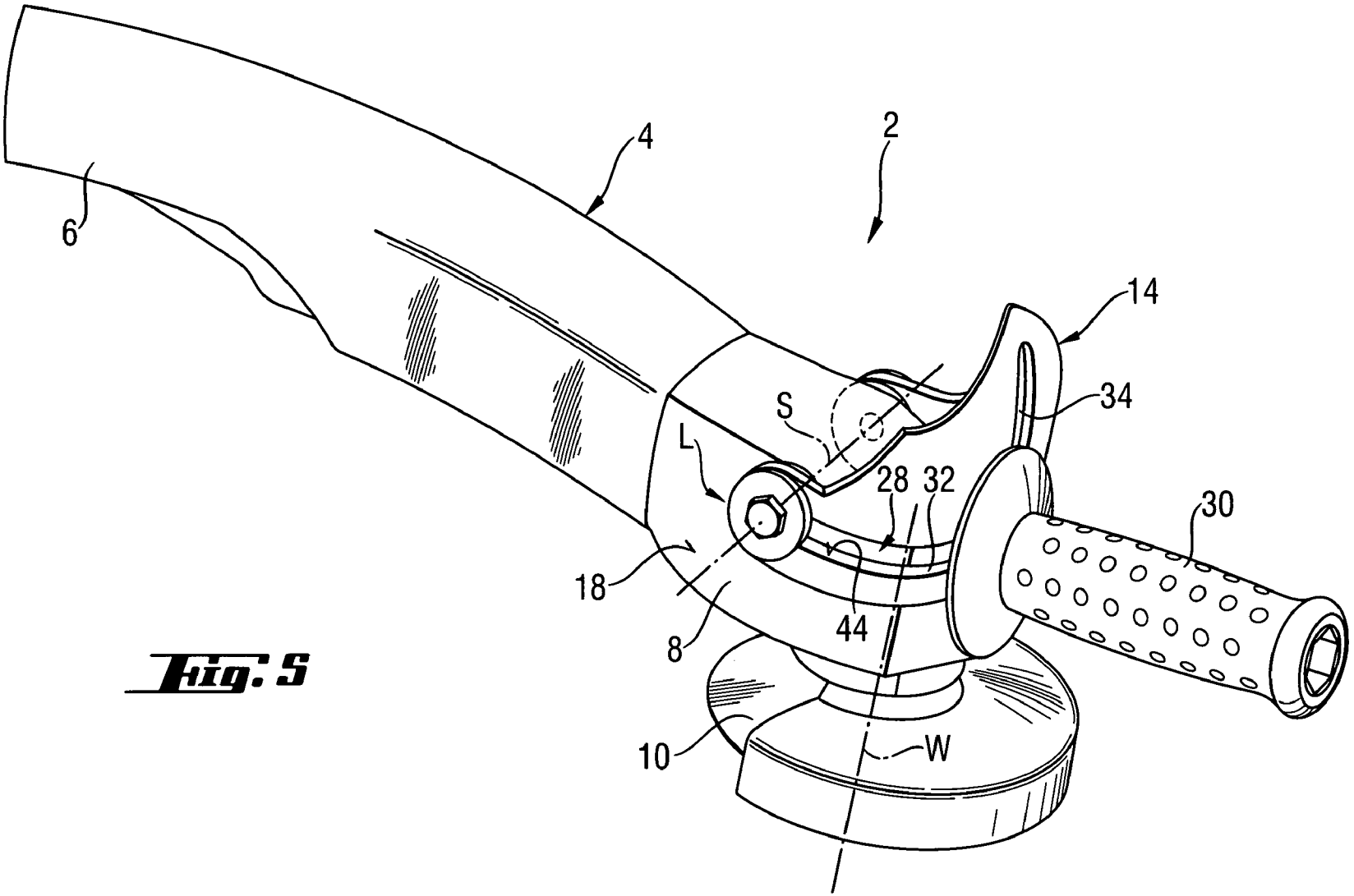
FIG. 5 a perspective view of the power tool shown in FIG. 1 with the pivoted support member.

FIG. 5 shows a pivotal position of the support member 14 relative to the position shown in FIG. 1. In the position shown in FIG. 5, the support member 14 is pivoted up to an end stop on the housing 4 remote from the main handle 6. The side handle 30 is secured in the opening 28 in the region of the opening 28 in which the elongate section 34 opens into the arcuate section 32. At this arrangement, the side handle 30 forms extension of the housing 4, extending from the gear housing 8, and the tool axis W of the tool disc 10 is located between the main handle 6 and the side handle 30. This position of the tool handles is particular suitable for grinding because in this position of the handles, a high press-on force can be conveniently applied in the direction of the tool axis W.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool (2), comprising:

a housing (4) having a main handle (6);

a side handle (30);

a support member (14) pivotable relative to the housing (4) and supporting the side handle (30) in different positions of the side handle (30) relative to the support member (14), wherein the support member (14) forms a guide along which the side handle (30) can be secured, with the guide formed by limiting surfaces (44) of an opening (28) formed in the support member (14); and means defining two support points (L) provided on opposite side surfaces (18) of the housing (4), wherein the support member (14) pivots about the two support points (L) relative to the housing (4);

wherein the support member (14) has an arcuate section (32) with the opening (28) therein and with the limiting surfaces (44) having a U-shaped profile extending from one of opposite side surfaces (18) of the housing (4) to another of the opposite side surfaces (18) to form the guide for the side handle (30).

2. A power tool according to claim 1, wherein the support member (14) surrounds a surface (20) of the housing (4) remote from a working tool (10) and forms a hand support surface (26).

3. A power tool according to claim 1, wherein the support member (14) forms a stirrup handle (24).

4. A power tool according to claim 1, wherein the support member (14) is removably connected with the housing (4).

5. A power tool according to claim 1, wherein the side handle (30) is removably connected with the support member (14).

6. A power tool according to claim 5, wherein the side handle (30) includes a locking device (36) for securing the side handle (30) to the support member (14).

7. A power tool according to claim 6, wherein the locking device (36) is actuated by rotation of the side handle (30) about a main axis (H) thereof.

8. A power tool according to claim 1, wherein the locking device (36) includes a side block (46) for guiding the locking device (36) along the opening (28).

9. A power tool according to claim 1, wherein the opening (28) in the support member (14) has an elongate section (34) forming the guide and extending transverse to a pivot axis (S) of the support member (14).

10. A power tool according to claim 9, wherein the elongate section (34) opens into the arcuate section (32).

11. A power tool according to claim 1, wherein the side handle (30) is knob-shaped.

* * * * *